United States Patent [19]

Tsunekawa et al.

[11] Patent Number: 4,706,457

[45] Date of Patent: Nov. 17, 1987

[54] APPARATUS FOR CONTROLLING WORKING GAS PRESSURE IN STIRLING ENGINES

[75] Inventors: Masaru Tsunekawa, Aichi; Yoshihiro Naito, Nagoya; Masaya Hyodo; Tatsuya Hayashi, both of Kariya, all of Japan

[73] Assignees: Aisin Seiki Kabushiki Kaisha; Kabushiki Kaisha Toyoda Jidoshokki Seisakusho, both of Aichi, Japan

[21] Appl. No.: 878,351

[22] Filed: Jun. 25, 1986

[30] Foreign Application Priority Data

Jun. 28, 1985 [JP] Japan ..... 60-140228

[51] Int. Cl.[4] ..... F02G 1/04

[52] U.S. Cl. ..... 60/521

[58] Field of Search ..... 60/521, 522

[56] References Cited

U.S. PATENT DOCUMENTS

| | | | |
|---|---|---|---|
| 3,372,539 | 3/1968 | Reinhoudt | 60/521 |
| 3,458,994 | 8/1969 | Heffner | 60/521 |
| 3,466,867 | 9/1869 | Brandes | 60/521 |
| 3,550,371 | 12/1970 | Jaspers | 60/521 |
| 3,554,672 | 1/1971 | Brandes | 60/522 X |
| 3,600,886 | 8/1971 | Jaspers | 60/521 |

*Primary Examiner*—Allen M. Ostrager

*Attorney, Agent, or Firm*—Burns, Doane, Swecker & Mathis

[57] ABSTRACT

Described is a working gas pressure control apparatus for a Stirling engine including a pressure boost valve provided in a minimum cycle pressure line connected to a working space by a first unidirectional valve, a pressure reducing valve provided in a maximum cycle pressure line connected to the working space by a second unidirectional valve, an operating lever for controlling the opening and closing of the pressure boost and pressure reducing valves, a compressor connected by the pressure reducing and the pressure boost valve to the cycle pressure lines, an unloading valve arranged in a circuit short-circuiting suction and discharge lines of the compressor, and a control unit for opening the unloading valve when engine rpm falls to a value lower than a preset rpm for engine idling, when the pressure boost valve is open and when the engine is operating in the steady state, thereby minimizing compressor load.

1 Claim, 3 Drawing Figures

APPARATUS FOR CONTROLLING WORKING GAS PRESSURE IN STIRLING ENGINES

BACKGROUND OF THE INVENTION

1. Field of the Invention:

This invention relates to an apparatus for controlling working gas pressure in a Stirling engine. More particularly, the invention relates to a working gas pressure control apparatus adapted to open an unloading valve when the rotational speed of a Stirling engine falls to a value lower than that for engine idling, when a pressure boost valve is opened, and when the engine is operating in the steady state, in such a manner as to minimize a load imposed on a compressor. The apparatus of the present invention may be effectively used for preventing engine stalling when the engine is installed in vehicles such as automobiles or forklifts.

2. Description of the Prior Art:

The output of a Stirling engine, which is an engine of the external combustion type, is determined by the pressure in a working space in which a working gas is sealed. For example, when it is desired to raise the output of a Stirling engine, the pressure of the working gas in the working space is raised. A typical prior-art output control device for a Stirling engine, such as described in the specification of Japanese patent publication No. 46-23534, is shown in FIG. 1. Each working space 1 of the engine is connected via a check value 2 to a compressor 3 by way of a maximum cycle pressure line 4 and a separate line 15. These lines 4 and 15 are connected to each other by a pressure reducing valve 5. Each working space 1 is also connected via another check valve 6 to the compressor 3 by way of a minimum cycle pressure line 7 and a separate line 16. These lines 7 and 16 are connected to each other by a pressure boost valve 8. Numeral 9 denotes a high pressure tank.

The downstream side of the pressure boost valve 8 is connected to a feedback piston cylinder 10, the piston 10*a* of which is connected via a piston rod 10*b* to one end of an accelerator lever 11, which serves as an actuating lever. A valve stem 12 of the pressure boost valve 8 and a valve stem 13 of the pressure reducing valve 5 are disposed in facing relation with respect to the sides of the accelerator lever 11. The piston 10*a* is moved as a function of the pressure in the feedback piston cylinder 10 in such a manner as to shift the position of a fulcrum 14 of the accelerator lever 11.

When it is desired to raise the output of the Stirling engine, the accelerator lever 11 is pushed leftwards to open the pressure boost valve 8 in order to supply the pressurized working gas to the working space 1 from the compressor 3 or tank 9. Conversely, when it is desired to lower the engine output, the accelerator lever 11 is pushed rightwards to open the pressure reducing valve in order to vent the pressure in the working space 1 toward the compressor 3 and lower the pressure within the working space 1. When the fluctuation in the engine output is within a predetermined range, that is, when the engine enters a stabilized steady-state phase of operation, the movable fulcrum 14 is shifted to close the pressure boost valve 8 and the pressure reducing valve 5.

During such steady-state operation, the compressor 3 operates to draw the working gas from line 15 and to discharge the pressurized working gas to line 16. This produces a large pressure differential between the lines 15 and 16, namely a large pressure change, which results in a greater work load upon the compressor 3 and a greater impediment to compressor operation. In order to overcome this inconvenience, it has been proposed in the the specification of Japanese patent publication No. 45-3124 to dispense with the pressure reducing valve 5 and to provide a bypass line 17 between lines 15 and 16 and a valve 18 in the bypass line 17. In accordance with this proposed system, the valve 18, which serves as the pressure reducing valve, is opened manually during steady-state engine operation to substantially equalize the working gas pressure between the lines 15 and 16. As a result, the working gas is returned during the steady-state operation from line 16 to compressor 3 by way of lines 17 and 15 so that the compressor 3 is substantially relieved of a compressive load. This makes it possible to eliminate the aforementioned impediments to compressor operation. However, this system is not completely satisfactory when one considers the operational impediments to which the compressor 3 may be subjected if one fails to perform the painstaking operation of manually opening the valve 18 when the engine begins operating in the steady state and manually closing the valve 18 at deceleration.

Accordingly, Japanese patent publication No. 46-23535 teaches to provide two operating levers 11 one of which is used to control the opening and closing of the bypass valve 18. However, this proposed system requires that the lever be operated manually to open and close the bypass valve 18. Moreover, a considerable manual force is required to operate the lever because of the pressure differential between the upstream and downstream sides of the bypass valve 18.

In addition to the inconvenience of requiring a large operating force for the actuating or accelerator lever, the aforementioned prior-art systems are inconvenient in that when the rotational speed of the engine falls below that for engine idling in the idling state, the engine may stall because of the load applied to the compressor.

SUMMARY OF THE INVENTION

An object of the present invention is to provide a solution to the above-described problems encountered in the prior-art systems.

According to the present invention, the foregoing object is attained by providing an apparatus for controlling working pressure in a Stirling engine comprising a pressure boost valve provided in a minimum cycle pressure line connected to a working space by a first unidirectional valve, a pressure reducing valve provided in a maximum cycle pressure line connected to the working space by way of a second unidirectional valve, an operating lever for controlling the opening and closing of the pressure boost and pressure reducing valves, a compressor connected to said cycle pressure lines by said pressure reducing valve and said pressure boost valve, an unloading valve arranged in a circuit short-circuiting suction and discharge lines of the compressor, and a control unit for opening the unloading valve under conditions when the rotational speed of the engine falls to a value lower than a preset idling rotational speed, when the pressure boost valve is open, and when the engine is operating in a steady state.

During acceleration, at which time the pressure boost valve is open, and during steady-state operation excluding the engine idling time interval, an electric circuit leading to the unloading valve is closed to open the unloading valve. The working gas from the compressor is then conveyed through the bypass circuit so as to be returned again to the compressor so that the load imposed on the compressor is reduced to an extremely small value. Similarly, when the rotational speed of the engine is less than that for idling, the unloading valve is opened to reduce the load imposed on the compressor.

When the operating lever is moved in a direction which will reduce output to open the pressure reducing valve, the electric circuit leading to the unloading valve is opened by such movement of the operating lever, thereby closing the unloading valve. Since the pressure reducing valve is open in this state, the compressor operates to draw the working gas from the working space and maximum cycle pressure line, thereby lowering the pressure in the working space to establish the engine deceleration state. When engine operation makes the transition from the decelerated state to the steady state, the unloading valve is again opened. However, when the operating lever is in its idling position, the unloading valve is closed.

In accordance with the apparatus of the present invention, hydraulic pumps adapted for power steering or braking of automotive vehicles or for the lifting and/or tilting action of fork-lifts can be driven by a Stirling engine, which has been installed in the vehicle or fork lift, even while the engine is idling. For example, when a load is applied to the hydraulic pump by setting a rest swing mode of operation, the compressor load can be eliminated. This diminishes engine load correspondingly so that engine stalling can be prevented.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
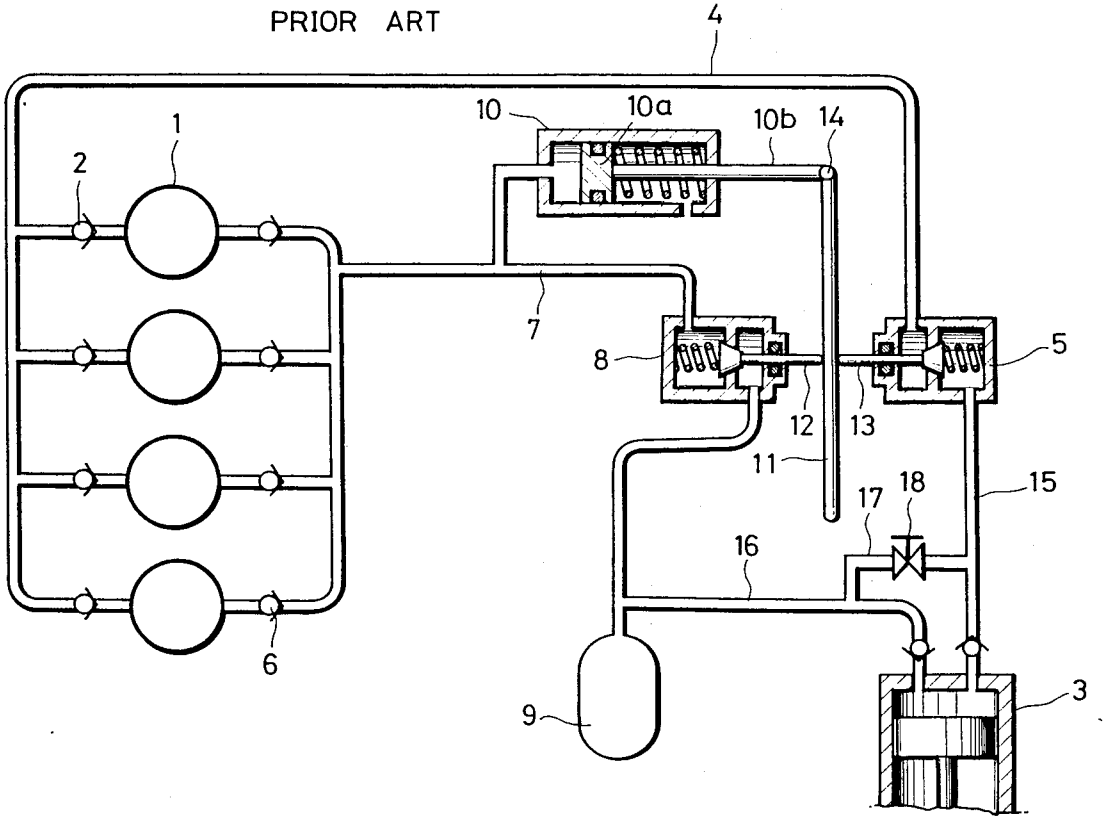
FIG. 1 PRIOR ART
FIG. 1 is a schematic view illustrating an example of the prior-art pressure control apparatus.

A preferred embodiment of the present invention will now be described with reference to FIGS. 2 and 3, wherein portions identical with those shown in FIG. 1 are indicated by like reference numerals and the corresponding description is omitted.

Provided between the operating lever 11 and the pressure reducing valve 5 is a switch 19 for sensing movement of the operating lever 11 in the direction of the pressure reducing valve 5. The switch 19 comprises a contactor 20 consisting of a spring-loaded electrically conductive plate secured to a valve stem 13, and a pair of terminals 21 arranged to face the contactor 20, one of the terminals 21 being connected to a power source V. and the other to one of the terminals 23 of an idling detection switch 22. The switch 22 has a spring-loaded contactor 24 moved away from the terminal 23 by a rod 11*a* contacted by the operating lever 11 during engine idling. The other of the terminals 23 is connected to a magnetic valve 18 serving as an unloading valve.

Figure 2:
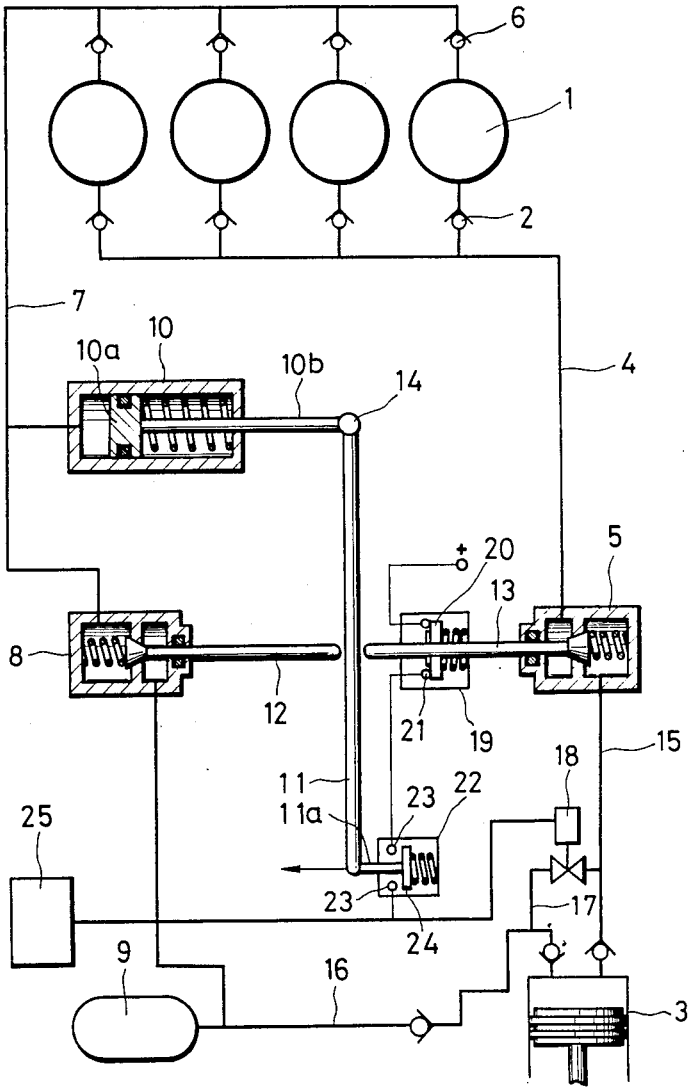
FIG. 2 is a schematic view illustrating an example of the pressure control apparatus according to the present invention.
Figure 3:
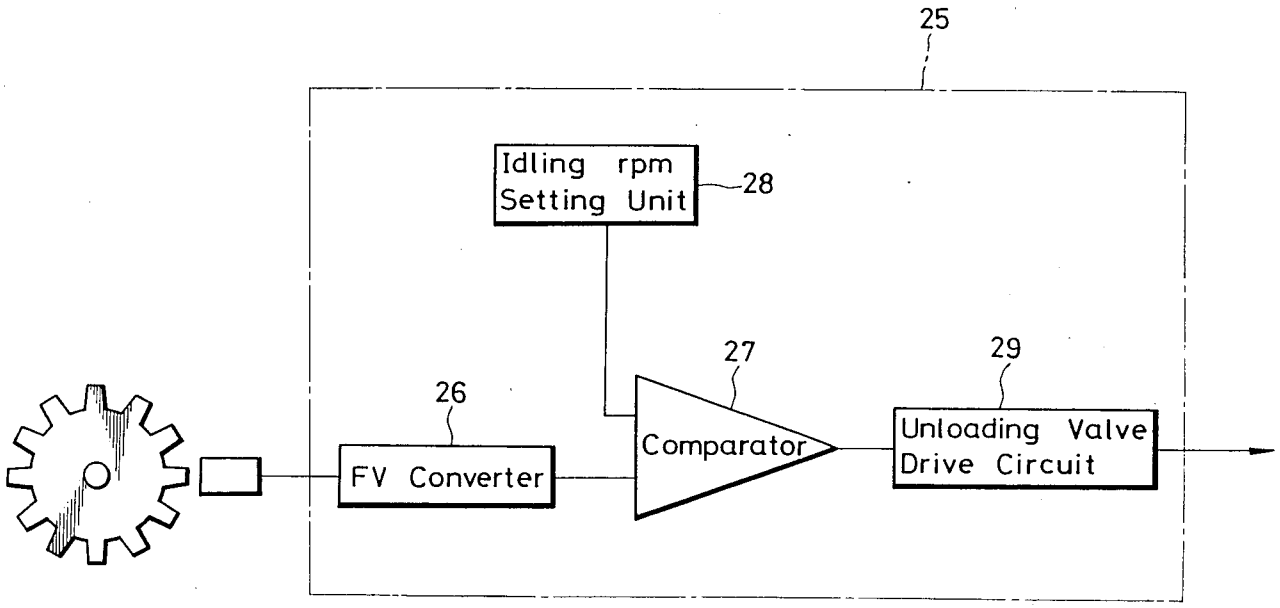
FIG. 3 is a block diagram of an electronic control circuit employed in the apparatus shown in FIG. 2.

It will be appreciated from FIG. 2 that, during engine idling and on occasion of movement of the operating lever 11 in a direction which will open the pressure reducing valve 5, the power source and the unloading valve 18 are electrically disconnected from each other, as a result of which the unloading valve 18 is closed.

One of the terminals 23 of the idling detection switch 22 is connected to an electronic control unit 25. As shown in FIG. 3, pulses obtained from the engine output shaft and indicating the rotational speed of the engine are received by the control unit 25 converted into a corresponding analog output signal by an FV converter 26. The resulting analog signal is compared in a comparator 27 with the output of an idling rpm setting unit 28. When the actual rotational speed (rpm) of the engine is lower than the set idling rpm, an unloading valve drive circuit 29 is actuated to open the unloading valve 18, thereby relieving the compressor 3 of a compressive load to reduce the engine load.

Referring again to FIG. 2, when the operating lever 11 is moved in a direction to open the pressure boost valve 8, the contactor 24 of the idling detection switch 22 makes electrical contact with the terminal 23 so that the power source and the unloading valve 18 are electrically connected with each other to open the valve 18. It should be noted that when steady state operation is again established, the fulcrum 14 is moved to the right and the pressure boost valve 8 is closed. The unloading valve 18, however, remains open.

As many apparently widely different embodiments of the present invention can be made without departing from the spirit and scope thereof, it is to be understood that the invention is not limited to the specific embodiments thereof except as defined in the appended claims.

What is claimed is:

1. A working gas pressure control apparatus for a Stirling engine, which apparatus comprises:

a pressure boost valve provided in a minimum cycle pressure line connected to a working space by a first unidirectional valve;

a pressure reducing valve provided in a maximum cycle pressure line connected to said working space by a second unidirectional valve;

an operating lever for controlling opening and closing of said pressure boost valve and said pressure reducing valve;

a compressor connected by said pressure reducing valve and said pressure boost valves to said cycle pressure lines;

an unloading valve arranged in a circuit short-circuiting suction and discharge lines of said compressor; and a control circuit for opening said unloading valve when any one of a rotational speed of the engine falls to a value lower than a present rotational speed for engine idling, the pressure boost valve is opened, and the engine is in a steady-state mode of operation.

* * * * *